US005458201A

United States Patent [19]

Brim

[11] Patent Number: 5,458,201

[45] Date of Patent: Oct. 17, 1995

[54] ADAPTER FOR A FIRE EXTINGUISHER

[76] Inventor: Thomas J. Brim, 2705 Shenandoah, Royal Oak, Mich. 48073

[21] Appl. No.: 52,489

[22] Filed: Apr. 23, 1993

[51] Int. Cl.[6] ..... A62C 35/13; A62C 13/00

[52] U.S. Cl. ..... 169/26; 169/30; 169/38

[58] Field of Search ..... 169/19, 26, 30, 169/37, 38, 39, 40, 41, 51, 57, 71, 74, 89, 90; 239/203, 204

[56] References Cited

U.S. PATENT DOCUMENTS

| | | | |
|---|---|---|---|
| 1,831,193 | 11/1931 | Quitschalle | 169/89 X |
| 2,521,193 | 9/1950 | Thompson | 169/51 X |
| 2,661,805 | 12/1953 | Lim | 169/41 |
| 3,273,652 | 9/1966 | Neumann | 169/26 X |
| 3,972,373 | 8/1976 | Nichols et al. | 169/62 |
| 4,034,813 | 7/1977 | Le Day | 169/74 X |
| 4,124,077 | 11/1978 | Barge | 169/70 |
| 4,328,867 | 5/1982 | Heath | 169/58 |
| 4,328,868 | 5/1982 | Monte et al. | 169/62 |
| 4,420,047 | 12/1983 | Bruensicke | 169/53 |
| 4,436,159 | 3/1984 | Revay | 169/28 |
| 4,625,808 | 12/1986 | Halfpenny | 169/30 |
| 4,718,498 | 1/1988 | Davios et al. | 169/62 |
| 4,782,564 | 11/1988 | Sloan | 24/704.1 |
| 4,856,596 | 8/1989 | Hamernik | 169/89 X |
| 4,872,513 | 10/1989 | Gardner et al. | 169/57 |
| 4,905,950 | 3/1990 | Turner et al. | 248/313 |
| 4,939,797 | 7/1990 | Goettl | 239/204 X |

*Primary Examiner*—Andrew C. Pike
*Attorney, Agent, or Firm*—Brooks & Kushman

[57] ABSTRACT

An adapter (20) is mountable to a valve assembly (94) of a conventional fire extinguisher (22) to form a portable automatic fire extinguisher (25). The adapter (20) comprises a coupling (26) which is mountable to the valve assembly (94), an elongate conduit (28), and an automatic sprinkler head (24). When the adapter (20) is mounted to the fire extinguisher (22), the sprinkler head (24) is placed in fluid communication with the fire extinguisher (22) and is locatable adjacent a ceiling of a room. If a fire occurs in the room, the automatic sprinkler head (24) releases fluid from the fire extinguisher (25) onto the floor of the room. An insert (130) mountable within the automatic sprinkler head (24) has a passageway (156, 158) extending therethrough which directs the spray of fluid passing through the automatic sprinkler head away from the longitudinal axis of the sprinkler head (24).

4 Claims, 3 Drawing Sheets

ADAPTER FOR A FIRE EXTINGUISHER

TECHNICAL FIELD

The present invention relates to fire extinguishers and fire sprinkler heads.

BACKGROUND ART

There are many types of fire extinguishers including portable hand held fire extinguishers and those built into buildings. The portable hand-held fire extinguishers generally have a canister filled with a pressurized fluid. A valve assembly is located atop the canister and can be manually operated to release the pressurized fluid. A hose or nozzle is used to direct the spray of pressurized fluid from the canister.

Fire extinguishers built into buildings include a source of pressurized fluid, such as water, and a conduit system which is in fluid communication with automatic sprinkler heads which are generally located adjacent ceilings in the buildings. The automatic sprinkler heads often include fusible links or members which are heat sensitive and are used to control the release of the pressurized fluid. The heat is generally generated by a fire.

One shortcoming of the portable hand-held fire extinguishers is that they must be manually activated. In cases where portable fire extinguishers do have automatic release mechanisms, they typically are not designed for stand alone use in a room of a building. This is because their automatic release mechanisms are located adjacent their canisters and the canisters generally reside upon the floor. When a fire occurs, heat will rise from the fire and collect adjacent the ceiling. If the automatic release mechanism is located far from the ceiling, the fire can cause considerable damage prior to the automatic release mechanism activating.

The built-in fire extinguisher systems in buildings also have a number of faults. First of all, these systems are expensive to install. Second, as these systems are built into the buildings, they can be difficult and expensive to later modify to provide fire protection in a newly specified area. For example, additional fire protection may be needed in the area of a newly installed computer system or adjacent a Christmas tree. Or else, a different type of fire retardant fluid may be needed as opposed to water which is usually used in buildings.

A problem automatic sprinkler heads have is that they are not particularly well suited to direct pressurized fluid in a particular direction. Generally, the sprinkler heads spray a stream of water onto a deflector which then disperses the water over broad regions. Accordingly, these sprinkler heads are not well suited for directing water on highly localized areas.

The present invention is intended to overcome the above described shortcomings of conventional hand-held fire extinguishers, built-in fire protection systems, and automatic sprinkler heads.

SUMMARY OF THE INVENTION

A fire extinguisher adapter is provided which mates with conventional fire extinguishers having a canister filled with pressurized fluid and a valve assembly with a release mechanism for controlling the flow of fluid from the canister. The adapter comprises an elongate conduit, a coupling, and a sprinkler head. The elongate conduit has first and second ends. The coupling is adapted to fluidly connect to the valve assembly of the fire extinguisher and to the first end of the elongate conduit. The sprinkler head has an annular body with an inner bore in fluid communication with the second end of the elongate conduit. It also has a heat sensitive control means for controlling the flow of fluid through the sprinkler head in response to the amount of heat absorbed by the control means. When the coupling is mounted to the valve assembly and the release mechanism is activated to release fluid from the canister and into the conduit, the control means prevents fluid from passing through the sprinkler head until the control means has absorbed sufficient heat. The control means then allows the fluid to pass through the sprinkler head to spray pressurized fluid upon a fire. Preferably, the control means includes a fusible link.

The present invention further includes an insert mountable within an automatic sprinkler head. The sprinkler head has an inner bore terminating in an opening and has a control means for releasably sealing an opening in an inner bore of the sprinkler head for preventing fluid from flowing through the sprinkler head. When the control means allows fluid to flow through the sprinkler head, the pop-up body slides relative to the stationary body and extends through the opening in the inner bore of the sprinkler head. A transverse portion of the passageway may direct the spray of fluid perpendicular to the longitudinal axis of the inner bore. Accordingly, the spray need not deflect off a deflector portion of the sprinkler head. The insert may comprise a stationary body and a pop-up body which moves relative to the stationary body. The pop-up body has an inner passageway through which fluid may pass.

It is an object of the present invention to provide an adapter for a conventional hand-held fire extinguisher which includes an elongate conduit which spaces an automatic sprinkler head above a canister of a conventional fire extinguisher to provide a stand alone automatic fire extinguisher system which is readily transportable from room to room in a home or a building.

It is a further object to provide inserts mountable within sprinkler heads which assist in increasing fluid velocity leaving the sprinkler heads and which provide greater directional control of the spray of the pressurized fluid.

It is yet another object to provide an insert for a sprinkler head which has a pop-up body which pops out of a sprinkler head in response to a fire and directs the spray of pressurized fluid in a particular direction without the fluid bouncing off of a deflector of the sprinkler head.

These and other objects, features, and advantages will become readily apparent from the following description and accompanying sheets of drawings.

BEST MODES FOR CARRYING OUT THE INVENTION

Figure 1:
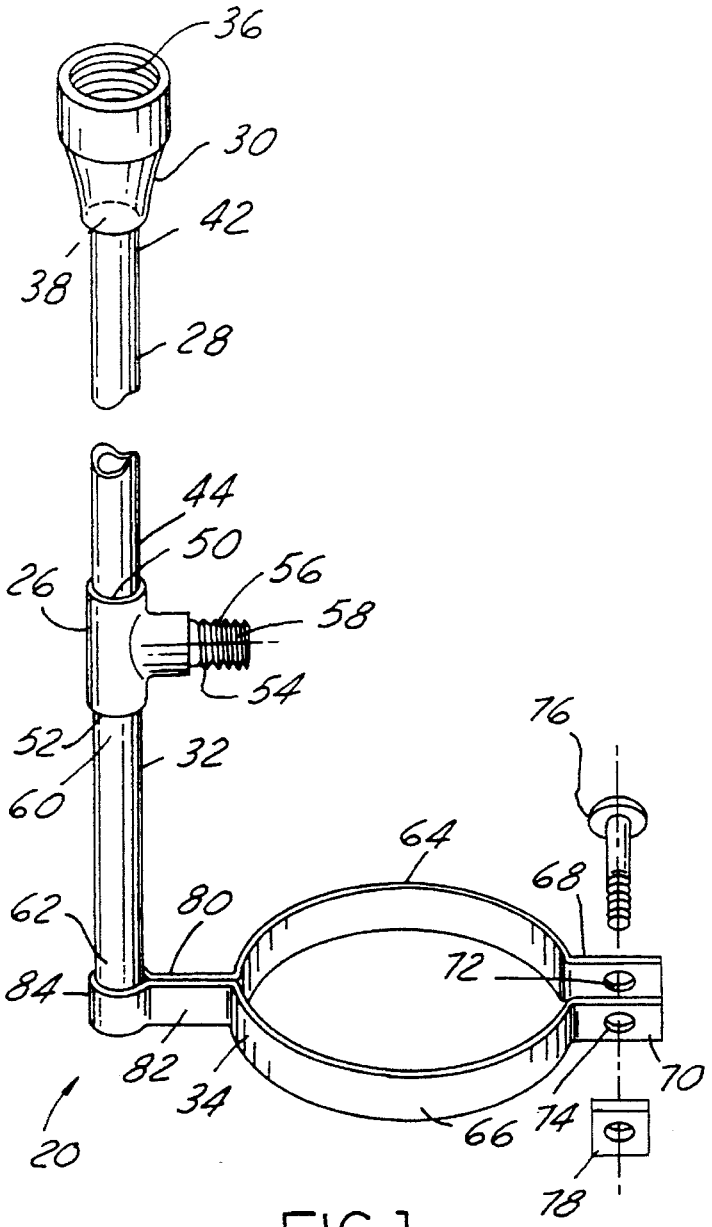
FIG. 1 is a perspective view of a fire extinguisher adapter, made in accordance with the present invention.

A fire extinguisher adapter 20, made in accordance with the present invention, is shown in FIG. 1. The adapter 20 is mountable to a portable hand-held fire extinguisher 22 and to an automatic sprinkler head 24 to create a portable automatic fire extinguisher assembly 25.

Adapter 20 comprises a coupling 26, an elongate conduit 28, a coupling 30, an extension 32, and a bracket 34. Coupling 30 has a first set of internal threads 36 adapted to receive sprinkler head 24, as will be described later, and a second set of internal threads 38 which adjoin to external threads on a second end 42 of conduit 28. A first end 44 of conduit 28 is threadedly joined to coupling 26 thereby cantileveredly supporting conduit 28 and sprinkler head 24 from the remainder of adapter 20.

Coupling 26 is T-shaped and has a first aperture 50 which receives conduit 28, a second aperture 52 into which extension 32 is threaded, and a third aperture 54 which secures a threaded nipple 56 having external threads 58. Extension 32 is preferably solid or else may be hollow with a plug therein to prevent fluid from flowing therethrough. Extension 32 has a first end 60 which is joined to coupling 26 and a second end 62 which is secured to bracket 34.

Bracket 34 includes a pair of semicircular portions 64 and 66 which are sized to clamp about the circumference of fire extinguisher 22. Bracket 34 also has a pair of extensions 68 and 70 with respective coaxially aligned apertures 72 and 74 which may be secured by a bolt 76 and a nut 78 to clampingly retain fire extinguisher 22 between semicircular portions 64 and 66. Extensions 80 and 82 are included in bracket 34 and connect to a cylindrical portion 84 which secures to second end 62 of extension 32.

Figure 2:
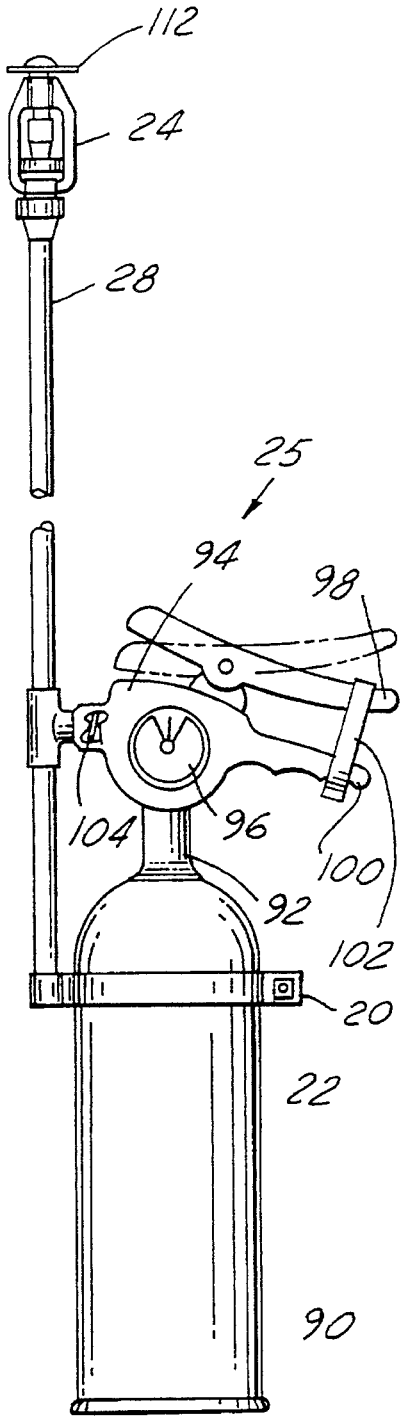
FIG. 2 is a side elevational view of a hand-held fire extinguisher with the adapter of FIG. 1 fluidly connected thereto.

Looking now to FIG. 2, adapter 20 is shown attached to fire extinguisher 22. Fire extinguisher 22 includes a cylindrical canister 90 which is attached to a neck portion 92. Located atop neck portion 92 is a valve assembly 94. Valve assembly 94 may be of any type which is commonly used with conventional fire extinguishers. A gauge 96 is fluidly attached to valve assembly 94 to indicate the pressure of the fluid located within canister 90. In the particular fire extinguisher 22 shown in FIG. 2, a lever 98 acts a release mechanism for controlling the flow of pressurized fluid through valve assembly 94. When lever 98 is in an up position relative to a handle 100, as shown in phantom, valve assembly 94 prevents pressurized fluid from leaving canister 90. Typically, conventional or standard fire extinguishers, such as fire extinguisher 22, will have a nozzle (not shown) for directing pressurized fluid exiting canister 90.

However, when adapter 20 is to be mounted to fire extinguisher 22, the nozzle is removed from fire extinguisher 22 and coupling 26 is threadedly and fluidly mounted to valve assembly 94. Valve assembly 94 has a threaded internal aperture 104 which threadedly receives the external threads 58 on nipple 56. Thereafter, elongate conduit 28 and extension 32 are joined to coupling 26. Bracket 34 is then secured to extension 32 and canister 90. To place valve assembly 94 in an open position, lever 98 and handle 100 are squeezed together and held in this open position by an elastomeric band 102. Therefore, pressurized fluid from canister 90 may exit fire extinguisher 22 through valve assembly 94 and pass into coupling 26 and conduit 28.

If adapter 20 were attached to fire extinguisher 22 only by coupling 26, a great deal of torque would be placed across coupling 26 due to the weight of conduit 28 and sprinkler head 24. Further, a reactive force due to pressurized fluid spraying from sprinkler head 24 would also be passed through coupling 26 and nipple 56 to valve assembly 94. To reduce the load transferring through nipple 56, bracket 34 is clamped about canister 90 with extension 32 connecting between bracket 34 and coupling 26. The moment arm provided by extension 32 greatly reduces the torque transferred across nipple 56, coupling 26, and valve assembly 94.

When a fire occurs in a room, heat rises and collects near the ceiling. Accordingly, this is where sprinkler heads having a heat-sensitive control means should be located. The combined height of fire extinguisher 22 and elongate conduit 28 therefore should place sprinkler head 24 proximate the ceiling of a room in which the automatic fire extinguisher 25 may be placed. For example, if the height of valve assembly 94 from the base of canister 90 is three feet, the elongate conduit 28 should be approximately 5½ feet long to place automatic sprinkler head 24 adjacent a nine-foot ceiling in a room. Of course, for rooms having different height ceilings, different lengths of elongate conduit 28 must be appropriately chosen. As fire extinguisher 22 and adapter 20 are both relatively lightweight, the automatic fire extinguisher assembly 25 may be easily transported from room to room as needed. Automatic fire extinguisher assembly 25 has been found to have sufficient weight so that it does not tip over when fluid is sprayed from sprinkler head 24.

In the preferred embodiment, canister 90 has a capacity of 2½ gallons and is ideally pressurized to 100 pounds when filled. Preferably, an air compressor can be used to pressurize the fire extinguisher and water may be employed as the fluid used to extinguish fires.

Figure 3:
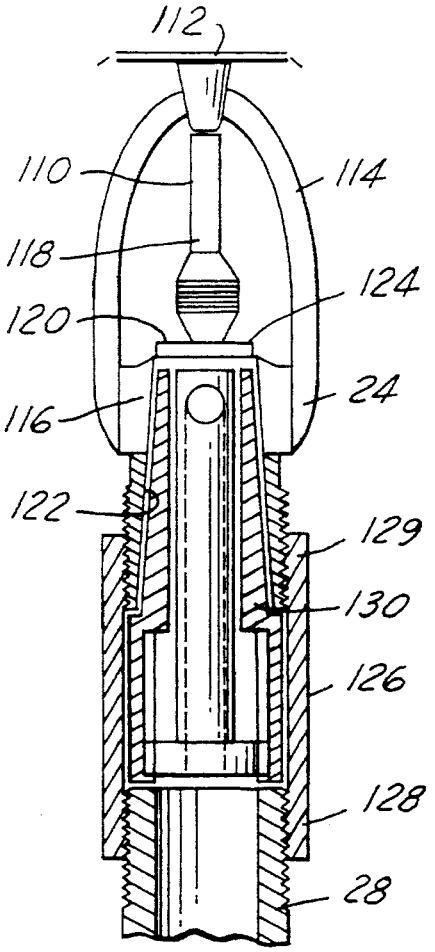
FIG. 3 is a side elevational view, partially in cutaway, of a sprinkler head with an insert mounted therein, the insert being held in a down position by a fusible link which is shown schematically.

Sprinkler head 24 is schematically shown in FIG. 3. Preferably, sprinkler head 24 is one which is sold by Reliable Automatic Sprinkler Co. of Mount Vernon, N.Y., and is model GRF with a HSW-1 horizontal side wall deflector thereon. However, sprinkler head 24 may be any type which has a control means which is responsive to heat to open an aperture in a bore to allow fluid to be sprayed through the sprinkler head. For example, the control means may include lead which softens when absorbing heat or else a control means which has a glass bulb filled with a liquid which bursts when sufficiently heated. In any event, fusible link 110 is representative of these types of control means which are commercially available with automatic sprinkler heads.

Turning now to FIG. 3, automatic sprinkler head 24 is shown in greater detail.

An arch 114 extends upwardly from an annular body 116. Deflector 112 is located at the apex of the arch 114. Fusible link 110 has an axial column 118 connected at one end to a cap portion 120 and to arch 114 at another. Annular body 116 has an inner bore 122 terminating in an opening 124. Cap portion 120 is received in and seals aperture 124 to prevent fluid from passing through inner bore 122 when the axial portion 118 of the fusible link 110 holds cap portion 120 in opening 124.

In the particular embodiment shown in FIG. 3, a collar 126 is shown connecting elongate conduit 28 to sprinkler head 24. Collar 126 has a pair of axially spaced ends 128 and 129 which are threadedly connected to elongate conduit 28 and to external threads located on annular body 116 of sprinkler head 24.

Figure 5:
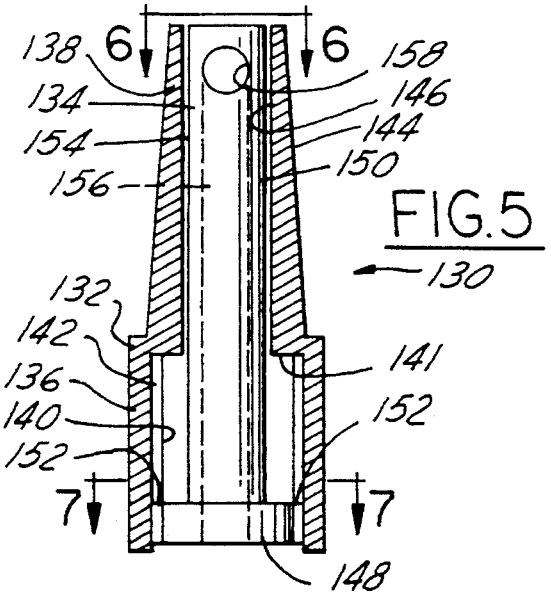
FIG. 5 is a side elevational view, partially in cutaway, of the insert of FIGS. 3 and 4.

FIG. 3 shows a two-piece insert 130 which is mounted within collar 126 and inner bore 122 of sprinkler head 124. Insert 130, as best seen in FIG. 5, includes a stationary body 132 and a pop-up body 134. Stationary body 132 has an annular portion 136 connected to a tapered portion 138. Cylindrical portion 136 has an inner bore 140 with a pair of diametrically opposed slots 142 therein. Tapered portion 138 has a tapered outer surface 144 and a cylindrical inner bore 146. A circular shoulder 141 is formed at the junction of inner bores 140 and 146.

Figure 6:
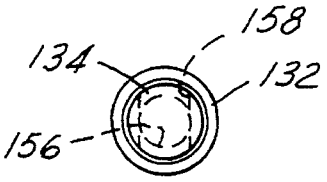
FIG. 6 is a top view taken along line 6—6 of FIG. 5.
Figure 7:
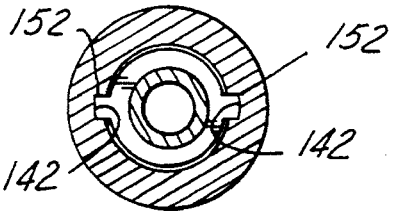
FIG. 7 is a sectional view taken along line 7—7 of FIG. 5.
Figure 8:
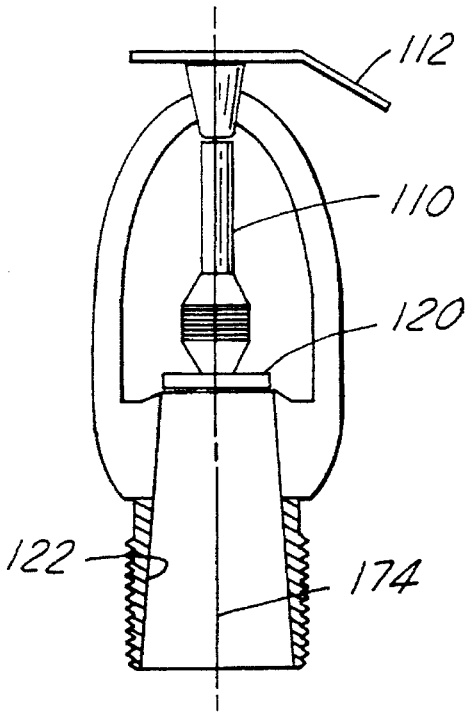
FIG. 8 is a sprinkler head with alternative embodiment of an insert located therein.

Pop-up body 134 is comprised of an enlarged head portion 148 and an elongate cylinder portion 150. Head portion 148 is generally annular and has a pair of diametrically opposed flutes 152 which are sized to be slidably received within slots 142 of stationary body 132. Cylinder portion 150 has an outer surface 154 which is telescopically received within inner bore 146 of tapered portion 138. Pop-up body 134 has an axial bore 156 which extends through head portion 148 and cylinder portion 150. Located adjacent the top end of cylinder portion 150 is a transverse bore 158 which connects with axial bore 156. Accordingly, fluid may pass axially through axial bore 156 and exit insert 130 through transverse bore 158. FIGS. 6 and 7 show cross-sectional views taken along lines 6—6 and 7—7 of FIG. 5 indicating that stationary body 132 and pop-up body 134 are generally cylindrical in cross-section. Flutes 152 interact with slots 142 to prevent pop-up body 134 from rotating relative to stationary body 132. Accordingly, the spray from transverse bore 158 can be directed.

Figure 4:
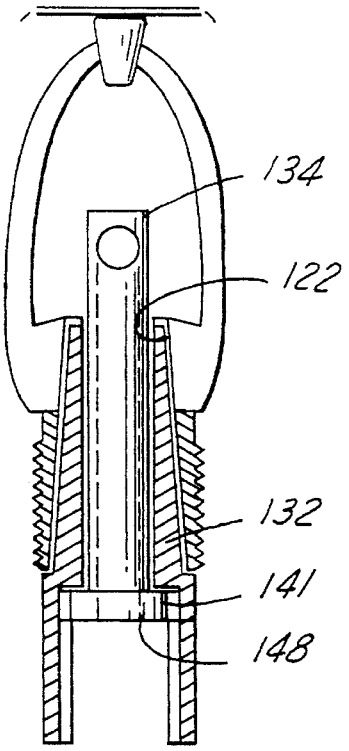
FIG. 4 is a side view, partially in cutaway, of the sprinkler head and insert of FIG. 3, with the insert in an up position with the fusible link having been removed.

FIGS. 3 and 4 demonstrate that pop-up body 134 may slide relative to stationary body 132. In FIG. 3, fusible link 110 is in place with cap portion 120 fluidly sealing aperture 124 in annular body 116 of sprinkler head 24. When fusible link 110 has absorbed sufficient heat, it becomes soft and the force of the fluid pressing upon pop-up body 134 becomes sufficient to buckle axial column 118 of fusible link 110. Axial portion 118 and cap portion 120 then break free from the remainder of sprinkler head 24 and arch 114 and fall from annular body 116.

Pop-up body 134, responsive to fluid pressure, then slides axially upward until head portion 148 seats against annular shoulder 141. As shown, transverse bore 158 now extends above inner bore 122 of sprinkler head 24. Accordingly, water or other pressurized fluid will flow through axial bore 156 and exit transverse bore 158. As transverse bore 158 is cylindrical, water is directed transversely and exits forming a conical spray. Therefore, insert 130 with pop-up body 134 provides for a directed spray rather than a deflected spray off of deflector 112. Accordingly, the spray of pressurized fluid can be more accurately directed then by using sprinkler head 24 alone. Also, axial bore 156 and transverse bore 158 are smaller in diameter than the inner bore 122 of sprinkler head 24; thus the velocity of fluid leaving sprinkler head 24 is greater than if insert 130 had not been used.

Figure 10:
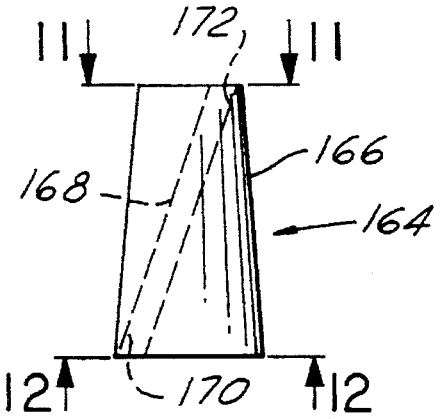
FIG. 10 is a side elevational view of the insert of FIG. 8.
Figure 11:
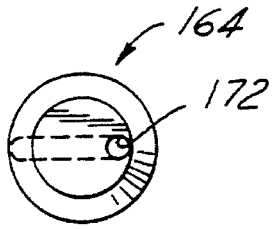
FIG. 11 is a top view taken along line 11—11 of FIG. 10.
Figure 12:
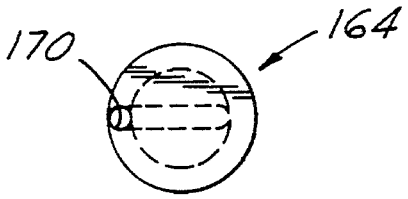
FIG. 12 is a bottom view taken along line 12—12 of FIG. 10.

FIG. 10 shows an alternative embodiment for an insert 164. Preferably, insert 164 is made of a molded plastic. Insert 164 has a frustoconical exterior surface 166 which is sized to fit within the inner bore 122 of sprinkler head 24. Passing diagonally through insert 130 is a passageway 168 which connects entrance and exit apertures 170 and 172. Insert 164 may telescopically slide within inner bore 122 of sprinkler head 24, in conjunction with fluid pressure, to pop fusible link 110 out of place when fusible link 110 has been sufficiently weakened by the absorption of heat. However, due to the shape of frustoconical exterior surface 166, insert 164 will be captured within inner bore 122.

Figure 9:
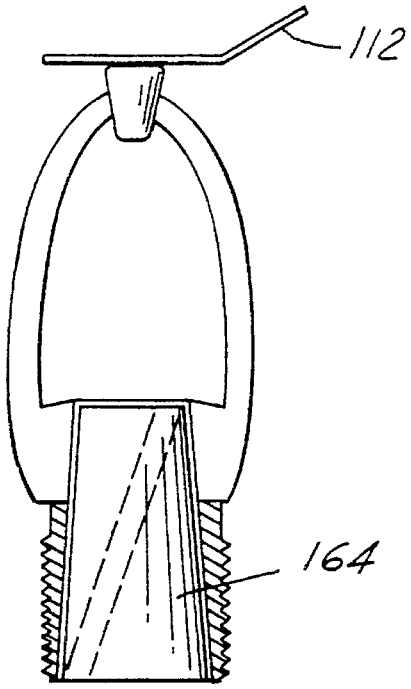
FIG. 9 shows the sprinkler head of FIG. 8 with a fusible link having been removed.

As shown in FIG. 9, with cap portion 120 gone, water is directed away from the longitudinal axes 174 of sprinkler head 24. Instead, the spray of fluid will strike a deflector 112 to spray in a predetermined direction. Deflector 112 is shown to be planar in FIG. 9. However, deflector 112 can be shaped to be conical or otherwise to provide a focused spray of fluid.

While the foregoing specification of this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principals of the invention.

What is claimed is:

1. A freestanding fire extinguisher assembly to extinguish a fire in response to heat created by the fire, the assembly comprising:

a fire extinguisher having a canister filled with a pressurized fluid and a valve assembly with a release mechanism for controlling the release of the fluid from the canister;

a rigid elongate conduit having first and second ends;

a coupling fluidly connecting to the valve assembly and to the elongate conduit;

an automatic sprinkler head having a body with an inner bore in fluid communication with the second end of the elongate conduit and having a heat-sensitive control means for controlling flow of the fluid through the sprinkler head in response to heat absorbed by the heat-sensitive control means; and a support affixed to the elongate conduit or the coupling and affixed to the canister to provide support to the elongate conduit or the coupling to counter torque applied by the elongate conduit to the coupling or the support, the support including a clamp which clamps about the canister;

wherein when the release mechanism is activated to release the fluid from the canister and into the elongate conduit, the control means prevents fluid from passing through the sprinkler head until the control means has absorbed sufficient heat, the control means then allowing the fluid to pass through the sprinkler head and spray upon the fire with the fire extinguisher assembly freely standing without requiring further support during spraying of the fluid.

2. The adapter of claim 1 wherein:

the elongate conduit extends vertically above the fire extinguisher so as to place the sprinkler head proximate a ceiling of a room where the heat may accumulate during the fire when the canister is set upright upon a floor.

3. The assembly of claim 1 wherein: the elongate conduit is cantilevered from the support.

4. A freestanding fire extinguisher assembly to extinguish a fire in response to heat created by the fire, the assembly comprising:

a fire extinguisher having a canister filled with a pressurized fluid and a valve assembly with a release mechanism for controlling the release of the fluid from the canister;

a rigid elongate conduit having first and second ends and cantileveredly mounted to the fire extinguisher;

a coupling fluidly connecting to the valve assembly and to the elongate conduit;

a support including a bracket, spaced from the coupling and affixing to the canister, and an elongate member connecting the bracket to the coupling or the rigid elongate conduit; and an automatic sprinkler head having a body with an inner bore in fluid communication with the second end of the elongate conduit and having a heat-sensitive control means for controlling flow of the fluid through the sprinkler head in response to heat absorbed by the heat-sensitive control means;

wherein when the release mechanism is activated to release the fluid from the canister and into the elongate conduit, the control means prevents fluid from passing through the sprinkler head until the control means has absorbed sufficient heat, the control means then allowing the fluid to pass through the sprinkler head and spray upon the fire with the fire extinguisher assembly freely standing without requiring further support during spraying of the fluid.

* * * * *